United States Patent [19]

Reif

[11] Patent Number: 4,959,947

[45] Date of Patent: Oct. 2, 1990

[54] EQUIPMENT FOR MAKING AND PACKING A MULTIPLE-CONSTITUENT MIXTURE

[75] Inventor: Werner Reif, Ravensburg, Fed. Rep. of Germany

[73] Assignee: Motan Verfahrungstechnik GmbH & Co., Weingarten, Fed. Rep. of Germany

[21] Appl. No.: 349,230

[22] Filed: May 9, 1989

[30] Foreign Application Priority Data

May 11, 1988 [DE] Fed. Rep. of Germany ..... 3816202

[51] Int. Cl.[5] ..... B65B 1/32; B65B 7/00

[52] U.S. Cl. ..... 53/502; 53/240; 141/103

[58] Field of Search ..... 53/502, 475, 474, 473, 53/168, 240, 237; 141/114, 83, 103

[56] References Cited

U.S. PATENT DOCUMENTS

| | | | |
|---|---|---|---|
| 3,045,720 | 7/1962 | Juhgmeyr et al. . | |
| 4,074,507 | 2/1978 | Ruf et al. | 53/502 |
| 4,084,626 | 4/1978 | King | 141/7 |
| 4,526,215 | 7/1985 | Harrison et al. | 141/83 |
| 4,724,656 | 2/1988 | Tanaka | 53/240 X |
| 4,751,806 | 6/1988 | Gram | 53/240 X |

FOREIGN PATENT DOCUMENTS

| | | | |
|---|---|---|---|
| 386913 | 4/1965 | Switzerland . | |
| 1104301 | 2/1968 | United Kingdom . | |
| 8704404 | 7/1987 | World Int. Prop. O. | 53/502 |

*Primary Examiner*—James F. Coan

*Attorney, Agent, or Firm*—Spencer & Frank

[57] ABSTRACT

An apparatus for the production and packaging of a compound mixture, in which extremely accurate and rapid weighing-out, proportioning and packaging of individual components are achieved, is provided. For this, filling stations (4 to 6) are equipped with combined discharge, weighing and transfer devices (22) which allow single-component treatment. The mixture introduced into a plastic bag (30) is further treated in a separate welding station (37), an ejection station (42) and a monitoring weight station (45). A combined bag-suction device (9) with a bag compacter (10) and dust-extraction device (11) serves for the disposal of the empty bags (8) of the individual components and for the removal of dust in the system.

16 Claims, 2 Drawing Sheets

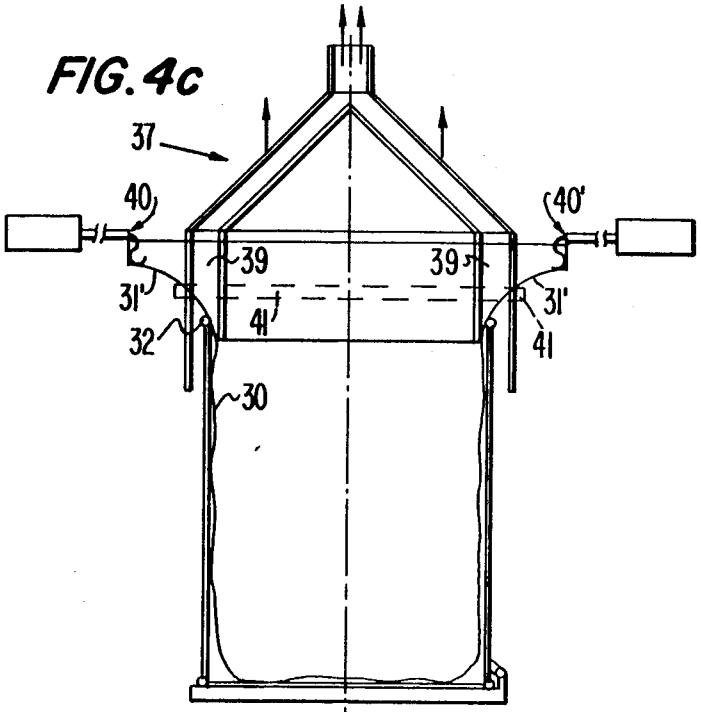
FIG. 4a
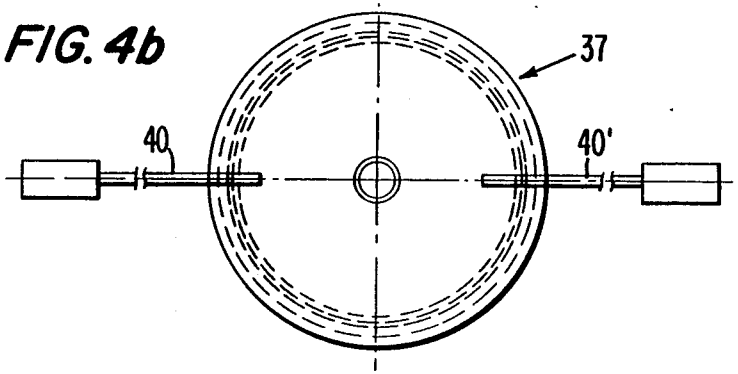
FIG. 4b
FIG. 4c
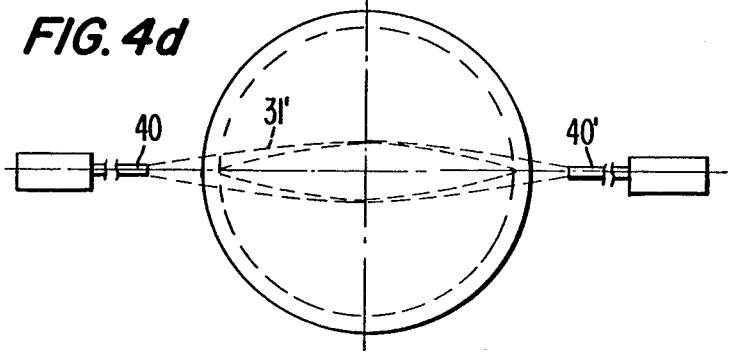
FIG. 4d

EQUIPMENT FOR MAKING AND PACKING A MULTIPLE-CONSTITUENT MIXTURE

BACKGROUND OF THE INVENTION

1. Field of the Invention

The invention relates to an apparatus for the production and packaging of a compound mixture.

2. Background Art

Known filling and packaging apparatuses for individual components comprise single-component vessels with an associated multi-component balance. A specific material composition is produced from the individual components by manufacturing the mixture by the additive proportioning of the individual components on a balance and subsequently packaging it. In particular, the weighing of chemicals in small quantities for medical technology or other sectors must be carried out with high-precision weighing devices. However, there can be considerable weight differences between the individual material components in each batch to be weighed out, thus to say, for example, a large quantity of the first material is mixed with a very small quantity of a second material. For this, the weighing devices to be used must cover very wide weight ranges, and this entails, on the one hand, a high technical outlay and, on the other hand, a finally unavoidable inaccuracy because of the weight ranges which are too large. Furthermore, the disadvantage of the additive weighing of individual components is that the weighing operation lasts for a very long time since it is concluded only when all the individual components are weighed out on the multi-component balance. Although several such multi-component balances or multi-component filling stations could be arranged in succession, nevertheless these cannot work in conjunction with one another, since each filling station conducts a self-contained work operation for the complete weighing out and filling of the individual components.

SUMMARY

An object on which the invention is based is to provide an apparatus for the production and packaging of a compound mixture, in which the abovementioned disadvantages are avoided and by means of which, in particular, a highly accurate weighing out and combination of individual components become possible, whilst at the same time a high throughput capacity or filling rate is achieved.

Starting from an apparatus of the type described in the introduction, this object is achieved, according to a first embodiment of the invention, by means of a system for packaging a compound mixture from individual components. The system has transport vessels which move containers from one feed vessel to another. Each feed vessel has an individual component discharge, weighing, and transfer device for accurately metering an individual component into a container. Electronic controls regulate the amount of material metered based on physical properties of the individual material and the amount weighed out. The container is then advanced by a timer or control device to successive feed vessels. After the desired mixture is made, a closing device closes the containers holding the compound mixture.

The packaging of chemicals in particular imposes the requirement of absolutely dust-free treatment. According to a further embodiment of the invention, this secondary object is achieved by means of a special empty-bag suction and bag-compacter device.

A further object is the dust-free introduction of the individual components, for example into a plastic bag, and a reliable closing of this container. According to the invention, this is achieved by the indirect subclaim 6. The same applies to the advantageous solution of the combined discharge, weighing and transfer device according to the indirect subclaim 4.

The remaining subclaims relate respectively to advantageous and expedient improvements of the overriding inventive idea.

The invention is based on the knowledge that an extremely accurate weighing operation is possible in an economically justifiable way and at high speed only with a single-component weighing device. The invention therefore provides the successive arrangement of singlecomponent vessels, each with an associated filling device, for recipes composed of one or more individual materials. Such a filling device is composed of a discharge device, if appropriate matched specially to the material to be filled, of a following weighing device and of a transfer device for transferring the weighed-out individual material into a vessel. This vessel is then conveyed with set timing to a subsequent filling station with a further individual material, and if appropriate the vessels can also be stationary and the feed vessels with the associated discharge, weighing and transfer device can be moved past them with a set timing. By means of the arrangement according to the invention, the individual stations can be specially coordinated respectively with the material to be discharged. For example, it is possible for one or more specific stations to have a cooling device for heat-sensitive products or for the discharge and weighing devices to be matched specially to the particular material. Of course, an attempt will be made to achieve substantial standardization of the individual components for reasons of cost.

A particular feature of the invention is the treatment of the materials which is as dust-free as possible, especially the method of loading the feed vessels. For this purpose, these are loaded with individual chemicals, for example from bags, and the emptied bags are conveyed by means of a vacuum, in a conveyor channel for empty bags, to a bag compacter located at the end of the apparatus. In order to extract the possibly harmful dust formations and vapors of the chemicals by suction, there is an additional suction device which likewise causes the dust or vapors to be extracted by suction via the bag channel.

Also essential to the invention and advantageous is the combination of an electronically controlled discharge device, for example in the form of an electronically controlled worm transport of the individual components from the feed vessel, the control taking place as a function of the weighing operation. Essential to the invention furthermore is a hemispherical weighing container which is assigned to the weighing station and which, by being rotated through 180°, makes it possible to obtain a complete emptying of the weighed material. Moreover, advantageously, the quantity to be adhered to exactly is determined by means of a controlled valve.

A further particular feature of the invention is the special closing device for the plastic bag used. In this respect, by means of a special device the upper edge of the plastic bag slipped over the vessel edge is sucked into an annular upper slit as a result of suction and is drawn apart by means of two laterally arranged grippers, in order thereafter to be welded together.

Furthermore, a special bag-ejection station with a following bag-monitoring balance is advantageous.

The advantage of the apparatus according to the invention is that it can be operated virtually fully automatically, thus to say normally only with one supervisor. At the same time, high throughput capacities are obtainable, at the same time with extremely high precision on and accuracy of the filling and packing operation.

Further details and particular features essential to the invention are illustrated in the drawing and explained in more detail with reference to the exemplary embodiment described below. In the drawing:

BRIEF DESCRIPTION OF THE DRAWINGS

FIGS. 4*a-d* show a detailed representation of the bag-edge suction facility according to the invention with a welding station.

DESCRIPTION OF THE PREFERRED EMBODIMENTS

Figure 1:
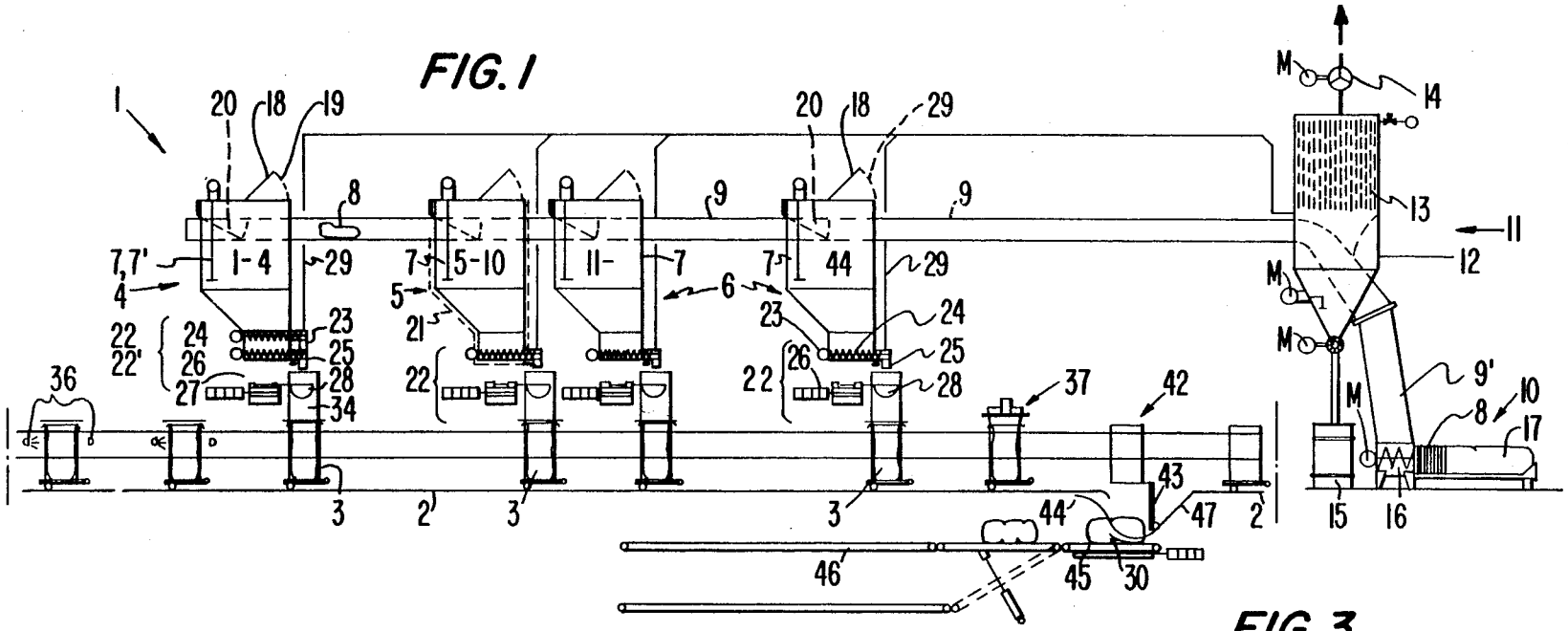
FIG. 1 shows an installation diagram of the apparatus according to the invention.
Figure 2:
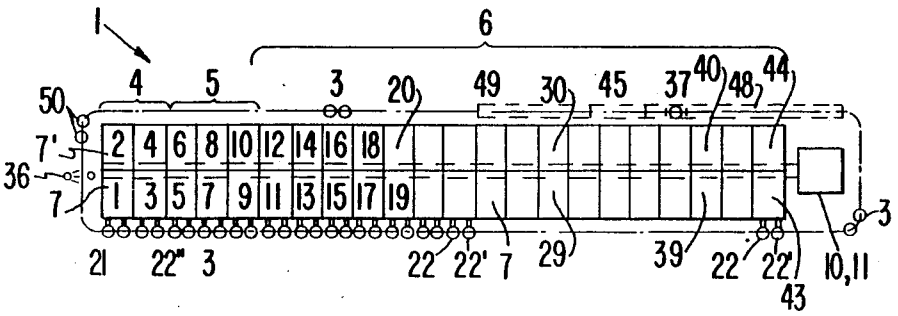
FIG. 2 shows a top view of an apparatus shown diagrammatically.

In the first particular exemplary embodiment, the apparatus 1 shown diagrammatically in a side view in FIG. 1 and a top view in FIG. 2 serves for the weighing out and packaging of individual chemicals. In general, up to approximately 10 individual components for producing a specific recipe are selected and proportioned from, for example, 44 different individual components.

Filling stations 4 to 6 are arranged in succession along a linear transport band 2 with individual vessels 3 displaceable thereon. As is evident from the top view of FIG. 2, two feed vessels 7, 7' are arranged in pairs next to one another on each filling station 4 to 6, so that, in the representation according to FIG. 2, there are, for example, twenty-two pairs of feed vessels arranged in succession, thus to say altogether forty-four feed vessels. In the exemplary embodiment, the feed vessels numbered 1 to 4 (filling stations 4), the feed vessels 5 to 10 (filling stations 5) and the feed vessels 11 to 44 (filling station 6) are respectively of identical design.

Accordingly, forty-four different materials can be treated in three different types of filling stations 4 to 6, a recipe preferably being selected from these materials.

The individual filling stations 4 to 6 with respective feed vessels 7 are loaded with individual chemicals from above. This is carried out, for example, by pouring the individual chemicals delivered in bags into the respective feed vessels 7 functioning as a silo or storage vessel. At the same time, a particular feature of the apparatus is that the cut-open and emptied plastic bags 8 are sucked up in a special conveyor channel 9 for empty bags and delivered to a special bag compacter 10. The conveyor channel serves at the same time as a suction channel for the dust or vapors generated during the introduction of the chemicals into the feed vessel 7. For this purpose, a special suction and filter device 11 is provided for generating the vacuum in the conveyor channel 9 and for filtering the dust or vapors. The suction and filter device 11 comprises a vessel 12, funnel-shaped in the lower region, an upper central filter 13, and a ventilator 14 located behind the filter and intended for generating the vacuum. Arranged underneath the funnel-shaped vessel 12 is a vessel 15 for residues from the vessel 12. The conveyor channel 9 passes through the vessel 12 and leads via the adjoining line 9' to the bag compacter 10. Here, the empty bags 8 are pressed to form bales 17 or packages by means of a worm conveyor 16.

In so far as the loading of the individual feed vessels 7 with individual chemicals takes place manually, each feed vessel 7, in its upper region, has a bag dumping chute 18 with a filling orifice 19 to the respective feed vessel 7 and an empty-bag discard orifice 20 to the conveyor and suction channel 9 for the empty bags 8.

In the exemplary embodiment, the filling stations 5, thus to say the individual vessels 5 to 10, are equipped with an outer water-cooling jacket 21 for heat-sensitive chemicals.

Each feed vessel 7 is assigned, in its lower region, a combined discharge, weighing and transfer device 22 for the individual component. This also applies to the arrangement, shown in FIG. 2, with feed vessels 7, 7' positioned next to one another. The discharge, weighing and transfer device of the rear feed vessel 7' is designated by the reference symbol 22'.

The first type of filling station 4 (individual vessels 1 to 4) illustrated in FIG. 1 has a discharge device 23 which is composed of two electronically controlled worm conveyors 24 arranged above one another and of an electronically controlled shutoff valve 25. The double worm conveyor serves for matching the proportioning capacity to the material to be conveyed or to the amount to be weighed out from the feed vessel 7.

The worm speed of the worm conveyor 24 is regulated electronically by the weighing device 26 which is arranged below it and which has a hemispherical weighing container 28 on an arm 27 rotatable through 180°. As a result of the electronically controlled worm transport of the worm conveyor 24, the quantity conveyed into the hemispherical container 28 by the worm is measured via the weighing device, and the worm drive is throttled back continuously towards the end of the measuring operation. Finally, exact proportioning can be ensured by the electronically controlled shut-off valve 25 provided between the worm conveyor 24 and the weighing container 28.

The discharge, weighing and transfer devices 22 of the further filling stations 5 and 6 do not differ fundamentally from that of the filling station 4. As shown in FIG. 1, these can have, for example, a discharge device 23 designed with only one worm conveyor 24, and the combined discharge, weighing and transfer operation can be matched to the particular specific component or material to be treated and contained in the respective feed vessel.

In FIG. 1, furthermore, there are additional suction lines 29 between the discharge, weighing and transfer device 22 and the suction and filter device 11, in order to keep even this region completely dust-free by the suction-extraction of dust and vapors.

Figure 3:
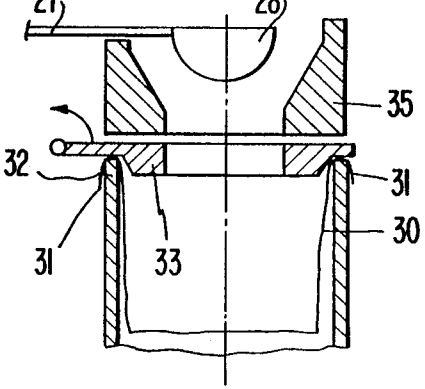
FIG. 3 shows the design of the container closure with connection to the filling station.

An individual vessel 3 is arranged underneath each discharge, weighing and transfer device 22, for receiving the material to be extracted from the particular filling station. For this purpose, the vessels 3 are loaded with a plastic bag 30 manually or automatically, the upper edge 31 of the plastic bag 30 being slipped over the vessel edge 32. As is evident furthermore from FIG. 3, the vessel 3 loaded with a plastic bag 30 is covered with a spectacle-shaped cover 33, so that the outer edge 31 of the plastic bag is protected behind a covering and cannot become dusty. The discharge, weighing and transfer device 22 in its lower region of the transfer device 34, has a connecting flange 35 which interacts with the spectacle-shaped cover 33 and which allows the material to be introduced from the transfer device 34 into the plastic bag 30 in an outwardly dust-free way. For this, the transfer operation takes place as a result of a rotary movement of the hemispherical weighing container 28 through 180°, so that the material contained in it is emptied.

Monitoring of the plastic bag inserted in the vessel 3 is carried out by the light barrier 36.

The individual vessels 3 shown in FIG. 1 are pushed successively on the linear transport band 2, so that no play can arise between the individual vessels 3. This is expedient where a large number of successively arranged filling stations 4 to 6 is concerned in order to ensure an extremely exact and simple positioning of the individual vessels underneath the respective filling station.

After the vessel has passed the last filling station 6, for example the individual station 44 or a last station preceding this, it is delivered to a special stationary welding station 37 shown in FIGS. 4*a-d*. In this or just in front of this welding station 37, the spectacle-shaped cover 33 is swung away laterally and a separate bag-edge suction device 38 is slipped over the vessel edge 32. The bag-edge suction device 38 has a slit annular channel 39, into which the upper edge 31 of the plastic bag 30 is sucked by means of a vacuum (edge 31'). At the same time, the upper bag edge 31 is grasped by two mutually opposite grippers 40, 40' projecting through the lateral slits and is drawn apart laterally (see FIG. 4*c*), so that the upper edge 31' of the plastic bag 30 comes to rest flat (see FIG. 4*d*). A plastic welding device 41 can then weld together the upper bag edge 31 sealingly, after the initial device 38 has been drawn away upwards. So that this welding operation can be carried out with absolute reliability, the upper edge 31 of the plastic bag 30 must be kept completely dust-free, this purpose being served by the spectacle-shaped cover 33 during the filling operation.

The welding station 37 is followed by an ejection station 42 for the filled plastic bags 30. For this, the vessel 3 is equipped with a pivotable flap 43 in its lower region, the flap 43 being opened gently and gradually by means of a cam control 44, in such a way that the bag 30 does not come abruptly up against the monitoring weigh station 45 located underneath the ejection station 42. By means of the monitoring weigh station 45, the exact total weight of the filled individual components is checked once again and, if appropriate, faulty batches are separated out. The weighed-out final product then passes on to a conveyor band 46 for further transport.

The vessel emptied in the ejection station 42 is transported further on the transport band 2, a cam control 47 or an equivalent mechanism causing the closing of the pivotable flap 43.

As shown in FIG. 2, the stations 37, 42, 45 arranged after the last filling station 6 can be designed as stations running parallel with the filling stations 4 to 6, so as to reduce the total length of the apparatus. FIG. 2 indicates an additional pivoting station 48 for swinging away the spectacle-shaped cover in front of the welding station 37. A faulty-batch band 49 located after the monitoring weigh station 45 is also indicated, the faulty batches being separated out of the system. The empty vessels 3 are filled with empty plastic bags 30 manually or automatically in a bag-filling station 50, before they are once again returned in the circuit to the first feed vessel 7 in the first filling station 4. The control light barrier 26 for the bag monitoring is also provided in front of this.

The invention is not restricted to the exemplary embodiment illustrated and described. On the contrary, it also embraces all developments open to an average person skilled in the art and without their own inventive content. In particular, the filling stations 4 to 6 can also be arranged on a circular or oval ring, the individual vessels 3 preferably once again being moved through with a set timing under the filling stations on the transport band 2. The further processing stations 37, 42, 45 can be located inside or outside the circular or oval transport arrangement.

It would also be conceivable for the transport vessels 3 to be stationary and for the filling stations 4 to 6 and the remaining stations to be movable with a set timing, but this would seem expedient only in special circumstances because of the increased technical outlay.

I claim:

1. A system for the production and packaging of a compound mixture from individual components of powdered fill material, comprising:
   - a plurality of transport vessels, each transport vessel having means for retaining a container for receiving and holding a compound mixture;
   - a transport means for transporting each one of said plurality of transport vessels;
   - a timing means operatively connected to said transport means for causing said vessels to be transported in a predetermined sequence; and
   - a plurality of feed vessels, each one of said plurality of feed vessels including:
     - a receptacle for receiving and storing an individual component of powdered fill material;
     - an individual powdered fill material component discharge, weighing, and transfer means disposed adjacent to said receptacle for discharging, weighing, and transferring a predetermined amount of an individual component of powdered fill material from said receptacle into a container received in one of said transport vessels; and
     - electronic control means operatively connected to said discharge, weighing, and transfer means for regulating and determining the amount of material discharged from said feed vessel into a container as a function of the weight and of the individual physical properties of the individual powdered fill material discharged; and
   - a closing device for closing a container having a compound mixture from a plurality of individual components of fill material therein.

2. A system as defined in claim 1, further comprising a conveyor means adjacent to said plurality of feed vessels for conveying away empty bags; and
   - a bag compactor attached to said conveyor means for compacting empty bags received from said conveyor means.

3. A system as defined in claim 2, wherein said conveyor means comprises a pneumatic conveyor for conveying empty bags by action of low pressure air.

4. A system as defined in claim 3, further comprising a filter system fluidly connected to said pneumatic conveyor means for extracting and filtering dust and vapors from the empty bags conveyed by said pneumatic conveyor and for extracting and filtering dust and vapors from containers received in said transport vessels.

5. A system as defined in claim 1, wherein said individual component discharge, weighing, and transfer means is disposed below said receptacle, and which comprises a weighing device having a weighing container, and which comprises an electronically controlled worm conveyor for conveying an individual component from said receptacle to said weighing container, and which comprises a shut-off valve for blocking conveying of material from said worm conveyor to said weighing container, and wherein said electronic control means electronically connects said weighing device, said worm conveyor, and said shut-off valve.

6. A system as defined in claim 5, wherein said weighing container comprises a hemispherical container rotatable through about 180° for transferring material into a container received in one of said transport vessels.

7. A system as defined in claim 1, further comprising a bag-filling means, said bag-filling means including a spectacle-shaped cover having a filling orifice therein, said spectacle-shaped cover holding a plastic bag having an open end in a container received in one of said transport vessels, and said spectacle-shaped cover having means for keeping a free edge of an open end plastic bag dust-free.

8. A system as defined in claim 7, further comprising a bag-sealing means for sealing a free edge of an open end plastic bag when the bag has been filled with a compound mixture.

9. A system as defined in claim 8, wherein said bag-sealing means includes:

a bag-edge suction device for applying force to and raising the free edge of the open end plastic bag received in said container, said bag-edge suction device including an annular vacuum channel for being placed over an upper edge of a container and transport vessel in which a bag is received for raising the free edge of the bag;

a pair of spaced opposed grippers for grabbing and pulling the free edge of a bag raised by said bag-edge suction device for causing the free edge of a bag to define a flat edge portion; and a plastic-welding device for welding the flat edge portion of a bag formed by said pair of spaced opposed grippers for sealing the bag.

10. A system as defined in claim 1, wherein said closing device comprises a bag-sealing means, including:

a bag-edge suction device for applying force to and raising the free edge of the open end plastic bag received in said container, said bag-edge suction device including an annular vacuum channel for being placed over an upper edge of a container and transport vessel in which a bag is received for raising the free edge of the bag;

a pair of spaced opposed grippers for grabbing and pulling the free edge of a bag raised by said bag-edge suction device for causing the free edge of a bag to define a flat edge portion; and a plastic-welding device for welding the flat edge portion of a bag formed by said pair of spaced opposed grippers for sealing the bag.

11. A system as defined in claim 1, further comprising a container ejection station for ejecting containers closed by said closing device, said ejection station including an automatic pivotable flap for moving a closed container away from said sealing device.

12. A system as defined in claim 10, further comprising a monitoring weigh station for weighing closed containers.

13. A system as defined in claim 1, further comprising a monitoring weigh station for weighing closed containers.

14. A system as defined in claim 1, wherein said plurality of feed vessels is arranged in pairs of feed vessels.

15. A system as defined in claim 1, wherein each one of said plurality of feed vessels is substantially identical.

16. A system as in claim 1, further comprising a light-barrier monitoring device for detecting the presence of a container in said container retaining means of said transport vessel.

* * * * *